US011046484B2

(12) United States Patent
Hoyos

(10) Patent No.: US 11,046,484 B2
(45) Date of Patent: Jun. 29, 2021

(54) POURING SPOUT GUARD AND DRINKING AID

(71) Applicant: Claudio Hoyos, Sierra Madre, CA (US)

(72) Inventor: Claudio Hoyos, Sierra Madre, CA (US)

( * ) Notice: Subject to any disclaimer, the term of this patent is extended or adjusted under 35 U.S.C. 154(b) by 0 days.

(21) Appl. No.: 16/264,544

(22) Filed: Jan. 31, 2019

(65) Prior Publication Data

US 2019/0233169 A1 Aug. 1, 2019

Related U.S. Application Data

(60) Provisional application No. 62/624,554, filed on Jan. 31, 2018.

(51) Int. Cl.

| | |
|---|---|
| ***B65D 25/48*** | (2006.01) |
| ***B67D 7/00*** | (2010.01) |
| ***A47G 19/22*** | (2006.01) |
| *A47G 19/12* | (2006.01) |

(52) U.S. Cl.

CPC ..... *B65D 25/48* (2013.01); *A47G 19/2216* (2013.01); *B67D 7/005* (2013.01); *A47G 19/12* (2013.01)

(58) Field of Classification Search

CPC . B44D 3/12; A47J 36/14; B65D 25/48; B65D 2517/0049; A47G 19/2216; B67D 7/005

USPC ..... 222/570, 569, 475.1; 220/700–701, 718, 220/733

See application file for complete search history.

(56) References Cited

U.S. PATENT DOCUMENTS

| | | | | |
|---|---|---|---|---|
| 1,867,060 A * | 7/1932 | Carr | B65D 25/48 | 222/570 |
| 1,952,288 A * | 3/1934 | Saxon | B65D 25/48 | 222/569 |
| 1,959,584 A * | 5/1934 | Hurley | B65D 25/48 | 222/189.07 |
| 2,071,638 A * | 2/1937 | Lauterbach | B65D 25/48 | 222/569 |
| 2,106,381 A * | 1/1938 | Rough | B65D 25/48 | 222/570 |
| 2,145,632 A * | 1/1939 | Pollifrone | B65D 25/48 | 222/569 |
| 2,331,971 A * | 10/1943 | Gramp | B65D 25/48 | 222/570 |
| 2,435,036 A * | 1/1948 | Ferguson | B44D 3/128 | 220/701 |

(Continued)

FOREIGN PATENT DOCUMENTS

WO WO-2016149275 A1 * 9/2016

OTHER PUBLICATIONS

Bump_Definition of Bump by Merriam-Webster.pdf Obtained on Jul. 15, 2020.*

(Continued)

*Primary Examiner* — David P Angwin
*Assistant Examiner* — Randall A Gruby
(74) *Attorney, Agent, or Firm* — Risso I.P.

(57) ABSTRACT

A novel flexible pouring spout guard that can be removably affixed to glasses, mugs, tumblers or other similar vessels used for holding beverages and other liquids and employed in pouring or drinking from such vessel, or in transferring liquids out of such vessel and into a bottle or other container, is described.

13 Claims, 2 Drawing Sheets

(56) References Cited

U.S. PATENT DOCUMENTS 2,594,858 A * 4/1952 Bowman ..... B65D 25/48 222/570
2,627,367 A * 2/1953 Bork ..... B65D 25/48 222/570
2,636,650 A * 4/1953 Marrier ..... B65D 25/48 222/570
2,729,956 A * 1/1956 Gilbert ..... B65D 25/44 426/111
2,765,966 A * 10/1956 Davis ..... B65D 25/48 222/570
2,767,891 A * 10/1956 Beadles ..... B65D 25/48 222/570
2,873,881 A * 2/1959 Nichols ..... B65D 25/48 220/697
2,909,306 A * 10/1959 Inotay ..... B65D 25/48 222/570
3,074,604 A * 1/1963 Baroud ..... B44D 3/128 222/569
3,081,912 A * 3/1963 Goceliak ..... B65D 25/48 222/189.07
3,102,667 A * 9/1963 Ullevig ..... B65D 25/48 222/569
3,154,227 A * 10/1964 Anderson ..... B65D 25/48 222/475.1
3,429,478 A * 2/1969 Ward ..... B65D 25/48 220/717
3,463,366 A * 8/1969 Spencer ..... B65D 25/48 222/570
D222,829 S * 1/1972 Proctor ..... D9/447
3,695,488 A * 10/1972 Olsson ..... B65D 25/48 222/570
D226,652 S * 4/1973 Kenney ..... D9/447
3,961,732 A * 6/1976 Roberts ..... B44D 3/12 222/570
4,299,340 A * 11/1981 Hrytzak ..... B65D 25/48 222/189.07
D283,492 S * 4/1986 Nitsch ..... D9/436
D322,221 S * 12/1991 Neff ..... D9/435
D325,170 S * 4/1992 Frantz ..... D9/435
5,195,662 A * 3/1993 Neff ..... B44D 3/128 220/700
5,579,963 A * 12/1996 Murthi ..... B44D 3/128 222/570
D377,900 S * 2/1997 Ford ..... D9/435
D382,801 S * 8/1997 Samson ..... D9/435
7,134,574 B2 * 11/2006 Braunstein ..... B44D 3/128 222/108
7,322,495 B2 * 1/2008 MacClarence ..... A47J 36/14 222/570
8,291,543 B2 * 10/2012 McCoy ..... A47L 13/52 15/257.1
8,757,453 B1 * 6/2014 Olsson ..... B65D 25/48 222/570
D729,483 S * 5/2015 Kent ..... D32/54
D739,235 S * 9/2015 Wong ..... D9/447
9,475,613 B2 * 10/2016 Kent ..... B44D 3/12
9,631,382 B2 * 4/2017 Murphy ..... E04G 23/0203
D802,865 S * 11/2017 Dervin ..... D34/10
D822,485 S * 7/2018 Wager ..... D9/447
10,112,738 B2 * 10/2018 McCarthy ..... B65D 23/065
10,301,109 B2 * 5/2019 Dervin ..... A47L 13/52
2003/0183663 A1 * 10/2003 Herman ..... B44D 3/128 222/570
2005/0178805 A1 * 8/2005 Abrahams ..... A47J 36/14 222/570
2014/0319187 A1 * 10/2014 McGee ..... B65D 25/48 222/570
2018/0297751 A1 * 10/2018 Al-Housseiny ..... B44D 3/12

OTHER PUBLICATIONS

Bump _ Definition of Bump by Merriam-Webster.pdf; obtained on Jan. 16, 2021 from Merriam-Webster online dictionary.*

* cited by examiner

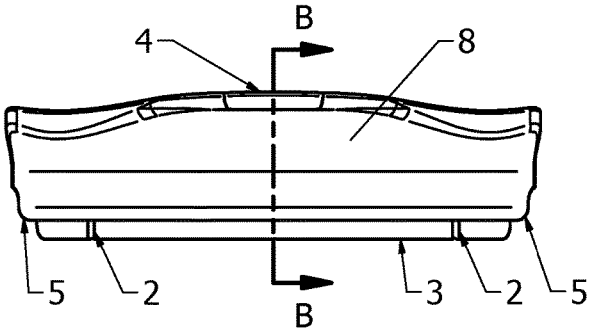
FIG. 6
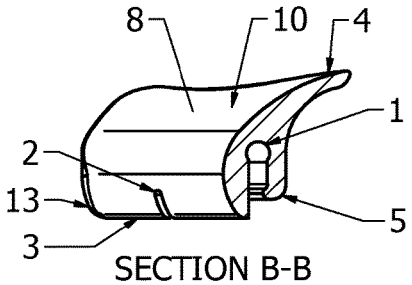
SECTION B-B
SCALE 1 : 1
FIG. 7
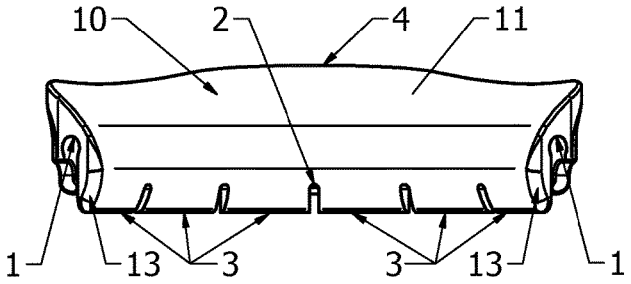
FIG. 8 (front)
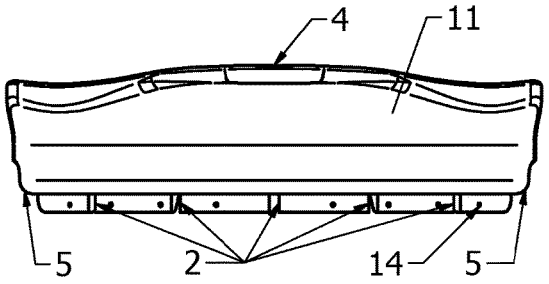
FIG. 9 (rear)
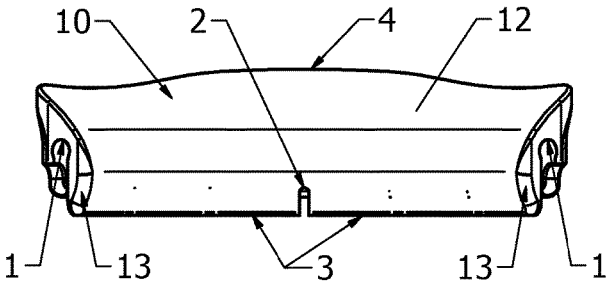
FIG. 10 (front)
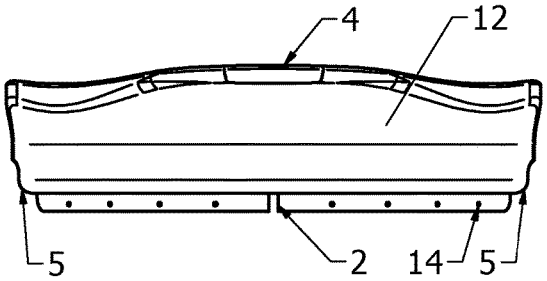
FIG. 11 (rear)

POURING SPOUT GUARD AND DRINKING AID

CROSS-REFERENCE TO RELATED APPLICATIONS

The present application is a Non-Provisional Utility Patent Applications claiming benefit of priority of U.S. Provisional Application No. 62/624,554, filed on Jan. 31, 2018, entitled "POURING SPOUT GUARD", the entire disclosures of which are hereby incorporated by reference.

BACKGROUND OF THE INVENTION

(1) Field of Invention

The present invention relates generally to a device to aid in pouring, transferring and/or drinking liquids and, more particularly, to a novel flexible pouring spout, spill guard and drinking aid that can be easily and firmly affixed to, and removed from, pots, pitchers, glasses, mugs or other similar vessels or container that hold liquids and provides means for facilitating and controlling the flow of such liquids out of such vessels or containers.

One particular area for which the present invention can be applied pertains to preparing baby formula. As the cost of microwave ovens has fallen substantially over the past two decades, microwave ovens have become fixtures in more and more household kitchens. These ubiquitous appliances are now used to heat a wide variety of food and beverage products, including baby formula. Milk or baby formula that is placed into a mug or glass and then warmed in a microwave is difficult to pour into a baby bottle without spillage due to the small opening for the bottle. While a traditional funnel can be used for transferring liquids from a mug to a baby bottle, the nature of the small passageway in such a funnel makes them difficult to clean, as might the materials from which they are made, all of which can lead to milk residue being built up over time, presenting potential health concerns or hazards.

Additionally, the average individual faces obstacles whenever trying to transfer the contents from any vessels that have been heated in a microwave to bottles or containers without the contents spilling or running down the outside of those bottles or containers. As a result, kitchens are increasingly stocked with microwave safe dishes, bowls, glasses and mugs. Along with defrosting and cooking frozen foods, microwave ovens are used to heat soups and to even boil water, for example before transferring the heated water into an insulated tumbler in order to make coffee or tea and which can be carry taken in the car or on public transit. Transferring these heated liquids presents difficulties, as the lips of glasses and mugs are prone to spillage when liquids are being poured. Similarly, soup warmed in a bowl or large mug is not easily transferred to an insulated beverage bottle, such as a Thermos® insulated container. It is the object of the present invention to provide a means for transferring liquids from one vessel to another that overcomes the deficiencies of the prior art.

Thus, the present invention is an improved pouring spout guard used for easily transferring liquids among or between vessels, bottles and/or containers without leaking, and which can also be used to provide more control over the flow of liquids when drinking out of such vessels or containers.

(2) Description of Related Art

This relates to a removable pour spout that aids in pouring liquids out of a variety of vessels, including, but not limited to, cooking vessels or drinking vessels, such as glasses, tumblers or mugs, either into bottles or other vessels or containers, or into a user's own mouth. Additionally, because mugs, glasses and other vessels are used to hold heated liquids, or can even be used to hold liquids while they are heated in microwave ovens, any such pouring aids must provide hands-free means for controlling the flow of liquids between the vessels and the containers and should avoid, or substantially reduce, the possibility of spills and burns.

Funnels and spouts have long been used in improving one's control over the flow of liquids when transferring them out of, or between, different vessels, containers, cooking pots, bowls, storage products and other items used to hold or deliver liquid contents, and various funnels and pour spouts can be found in the prior art. Many of these prior-art pouting spouts are of substantially fixed or rigid structures of a specific size, and are designed to be used with only vessels or containers of matching size, which limits their usefulness. Because they lack flexibility, it may be difficult for users of such spouts to securely attach them to a particular vessel or container, resulting in reduced usefulness and an increase in the likelihood of spills occurring and/or requiring the purchaser to secure multiple spouts of different sizes. Many of these rigid funnels and spouts are also not safe to use repeatedly with heated liquids; in fact, plastic not treated to handle extreme temperatures and the materials will degrade over time through repeated exposure to heated liquids, or otherwise and may become brittle or altered when exposed to extremes of heat or cold. Other prior art spouts that are flexible are not capable of creating a sufficiently strong and sealed connection with the vessels or containers to which they are applied and are thus prone to leaks and spills.

While some liquid transfers might be manageable using a funnel, funnels are not always optimal for transferring all types of beverages and liquids. Most funnels are made from simple plastic or metal materials, which can make them hard to manage when dealing with heated liquids, and can make cleaning more difficult. Additionally, the size of the opening in the funnel stem may not always be sufficiently wide so as accommodate the contents of all liquids, particularly those also containing solid matter, such as chili or heated soup containing pieces of chicken or vegetables. Depending on the properties of the materials from which they are manufactured, using a funnel for transferring liquid that is hot can sometimes impact on the taste of the beverages themselves. Additionally, the content of the liquid may negatively impact on the funnel or its integrity. For example, tomato-based soups may stain a plastic funnel or leave a residue that is not easily removed.

Furthermore, funnels can at times be difficult for a single person to use, as their proper use normally requires the use of 3 hands (one to hold the receiving container, one to hold the funnel and one to hold the pouring vessel), making funnels prone to spills or burns when utilized by a single individual. Because a funnel's stem extends down into body of the receiving vessel, the funnel needs to be lifted up during the pouring process in order to finish filling the receiving container. When a heated liquid is being transferred, holding or lifting the funnel can cause burns, discomfort, or even lead to the user knocking over or dropping the receiving container during the pouring process. It is the object of the present invention to provide a pouring spout that overcomes the limitations imposed by plastic funnels.

Additionally, funnels would not address the difficulties faced by persons attempting to transfer liquids from one glass or mug to another glass or mug (or similar wide-mouthed vessel), such as when dividing or splitting a glass of juice or a mug of coffee, which activities normally are undertaken outside of the kitchen where funnels would be kept. Because of the manner in which the lips of these vessels are formed, they are prone to spilling when pouring from one to another, even when the first is perfectly positioned to pour the contents into another vessel. The width of the stream of liquid being poured is not controlled or limited in any way by the top edges of the glasses or mugs, and as a result the stream of liquid being poured may be excessively wide and may even extend beyond the size of a funnel. Spills also often occur down the sides of the glasses or mugs themselves. Such spills or drips can often occur when liquid is drunk directly from the vessels, a problem that funnels would not be used to address.

Therefore, on account of the above, there is a continuing and unmet need for a novel device that can be applied to any type of liquid container or vessel, such as a glass, tumbler or mug, and used to assist in drinking from or transferring liquids out of those vessels to bottles, containers or other vessels without spillage. The tool should be able to accommodate different size beverage holders, able to withstand heat and cold, reusable, portable, chemically inert when exposed to fluids, resistant to melting or staining, and easy to clean.

SUMMARY OF INVENTION

The present invention provides an improved detachable liquid pouring spout Once secured to a liquid-holding vessel, the improved pouring spout aids in transferring liquid out of the vessel while reducing or eliminating spills.

Certain embodiments of the present invention include but are not limited to the following. An aspect of the present invention is to provide a novel flexible, detachable pouring spout guard that is applied to the rim of glasses, mugs or other vessels or containers used for holding liquids and is employed to facilitate the transference of liquids from such vessels to bottles, such as baby bottles, or other fluid or beverage containers or vessels. Such a pouring spout guard is desirable because these vessels can be used for holding liquids that are heated in microwave ovens or on a stove-top, and the liquid then transferred to smaller and/or more portable fluid or beverage containers, whose openings are frequently too small to permit the transfer of liquids from the heating vessels without spilling the heated liquids, or else divided among multiple containers or vessels.

By way of example, a parent may choose to warm baby formula or breast milk in a steel pot or a microwave oven by using a microwave oven-safe vessel or container such as a mug, glass, cup or bowl. The pouring spout guard of the present invention is therefore desirable because it can be applied to the vessel or container either before or after heating and used in the safe transfer of heated liquids to smaller and/or more portable fluid or beverage containers, such as baby bottles. Because the openings of baby bottles are generally small, the pouring spout guard permits the easy transfer of liquids from the microwaved vessels to the baby bottles with little or no spilling of the heated liquids.

The spout guard is fabricated from highly water-repellant, food safe, rubbery material (thermoset or thermoplastic) that is naturally or synthetically made. The preferable materials of manufacture for this pouring spout are silicone rubber (thermoset elastomer), and thermoplastic rubbers (thermoplastic elastomer) such as thermoplastic polyurethane (TPU), thermoplastic styrene (TPS), thermoplastic vulcanizates (TPV), and any other similar plastic rubber materials that allow the pouring spout guard to bend and yet be able to keep its original design and shape. The product can also be made out of thermoplastic polymer materials that can be recycled, such as polyvinyl chloride (PVC) soft materials or polyamide (PA) flexible nylon materials.

The pouring spout guard is curved with a rounded central channel formed by opposing inner and outer wall elements, and is designed to fit over the lip of a glass, mug, cup or similar vessel. The outer wall contains a latching element with a hook shape at the bottom while the inner wall contains a plurality of fixed gripping teeth elements, separated by grooves; together, these elements function as a latch spring mechanism that combines with the friction coefficient of the materials used in the manufacturing process and keeps the pouring spout guard firmly affixed during use. The plurality of gripping elements and the grooves between them, when combined with the elastomeric qualities of the manufacturing materials, enables the degree of curvature of the pouring spout guard to be increased or reduced, thereby allowing the pouting spout guard to be applied to different sized drinking vessels. The pouring spout guard of the present invention is designed so that its degree of curvature easily can be increased or reduced in order to accommodate the rims of glasses or mugs having openings of different circumferences. Further, the use of flexible manufacturing materials allows the product's rounded central channel to fit over vessels having a variety of lip thickness.

The improved pouring spout also reduces the likelihood of spilling the liquid as it leaves the vessel to which the pouring spout guard is affixed. The inner wall extends downward below the level of the outer wall latching element and the grooves formed in the inner wall between the multiple gripping teeth elements are of limited height in order to prevent water from seeping into the space between the inner wall element and the inner surface of the vessel. The counterbalanced forces produced by the outer latching lip and inner latching elements prevents liquids from leaking into the space between the inner wall of the pouring spout guard and the interior surface of the vessel, reducing dripping and spillage. Additionally, the pouring surface portion of the pouring spout guard utilizes a curvature, a small protrusion or bump on each side of the pouring surface, and an extended lip, all working in combination to direct the liquid into a centralized pouring area, thereby narrowing the width of the stream of liquid during the pouring process and reducing the chances of spillage. The pouring surface of the pouring spout guard starts broadly on the side aligning with the interior edge of the vessel and narrows towards the pouring lip portion that extends outside of the vessel, and utilizes the bumps on each side of the pouring spout to aid in channeling the liquid onto the pouring surface and into a narrower stream flowing over the pouring lip, thereby also helping to reduce or eliminate spills.

In one embodiment of the present invention, the removable pouring spout guard can be attached to a vessel used for heating liquids, such as a small cooking pot or any of a variety of beverage containers, including, but not limited to, glasses, mugs or tumblers used in holding heated liquids, or other microwave-safe vessels used for heating liquids in a microwave. Such a spout is desirable because it can be applied to the lip of the vessel containing these warmed liquids and used to transfer the liquids to smaller and/or more portable containers, including, but not limited to, Thermos® insulated containers or other transportable bottles or containers, whose openings are frequently too small to permit the transfer of liquids from the heating vessels without spilling the heated liquids.

In another embodiment of the present invention, the pouring spout guard is used to aid in preparing baby bottles by applying the pouring spout guard to a glass, mug or similar vessel holding heated milk or baby formula and safely and easily pouring such liquids into a baby bottle.

In another embodiment of the present invention, the surface of the sides of the central channel are textured to increase the frictional coefficient of the surfaces, thereby increasing the grip of the pouring spout on the vessels to which it is applied.

In another embodiment of the present invention, the pouring spout is made from materials that have been treated, such as by the addition of a pigment component, so that the pouring spout will change colors when exposed to heat or heated liquids that will warn users of the potential for being burned.

In another embodiment of the present invention, the spout guard is used for drinking directly from mugs, tumblers and other similar vessels; specifically, the spout guard provides a more controlled pouring surface, thereby reducing or eliminating the spills and drips that often occur when drinking from vessels having rounded lips, a function that can benefit small children; the elderly or the infirmed by allowing them means to safely and easily drink a variety of liquids.

Accordingly, with pour spouts several advantages are provided herein, with the presence of an improved means of functionality, portability, flexibility and adaptability.

Finally, as can be appreciated by one in the art, the present invention also comprises a method for forming and using the pouring spout guard described herein.

Other objects and advantages of the present invention will become apparent to those skilled in the art upon a review of the following detailed description of the preferred embodiments and the accompanying drawings.

BRIEF DESCRIPTION OF THE DRAWINGS

The accompanying drawings are included to provide a further understanding of the invention, and are incorporated in and constitute a part of this specification. The objects, features and advantages of the present invention will be apparent from the following detailed descriptions of the various aspects of the invention in conjunction with reference to the following drawings, where:

FIG. 6 is a rear view of the pouring spout guard of FIGS. 2-5; and

FIG. 7 shows a cross-sectional view of the pouring spout guard taken along the line B-B of FIG. 6.

FIG. 8 is a front view of a five-groove embodiment of the present invention.

FIG. 9 is a rear view of the five-groove embodiment of the pouring spout guard of FIG. 8.

FIG. 10 is a front view of a single-groove embodiment of the present invention.

FIG. 11 is a rear view of the single-groove embodiment of the pouring spout guard of FIG. 10.

REFERENCE NUMERALS

Figure 1:
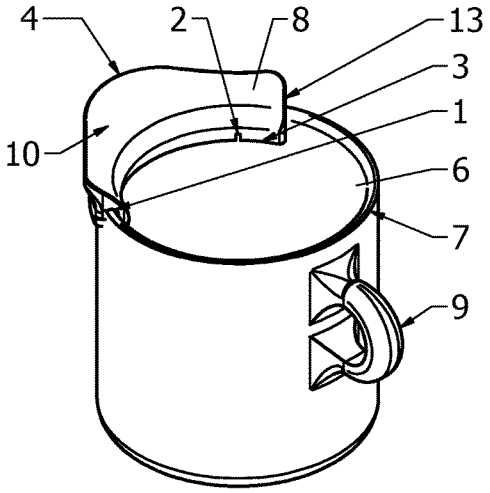
FIG. 1 is a perspective top view of a pouring spout guard being used with a coffee mug in accordance with various embodiments of the present invention.

The following reference numerals are used to identify various components and/or items as depicted in the figures:

1. central channel of pouring spout guard;
2. grooves between gripping elements;
3. inner gripping elements of pouring spout guard;
4. top pouring lip of pouring spout guard;
5. outer latching element of central channel of pouring spout guard;
6. coffee mug;
7. lip of coffee mug;
8. two-groove embodiment of pouring spout guard;
9. coffee mug handle;
10. top pouring surface of pouting spout guard;
11. five-groove embodiment of pouring spout guard;
12. single-groove embodiment of the pouting spout guard;
13. side edge bump;
14. textured surface on the interior of the inner gripping elements.

DETAILED DESCRIPTION

Reference will now be made in detail to one or more embodiments of the present invention, as illustrated in the accompanying drawings. The drawings and descriptions provided below are non-limiting examples of embodiments of the present invention, it being expressly understood that the invention can be modified as desired by those skilled in the art to achieve the desired functions. Wherever possible, the same reference numbers are used in the drawings and the description to refer to the same or like parts. The embodiments described below are illustrated to demonstrate the contents and characteristics of the present invention and to enable one of ordinary skill in the art to make and use the present invention and to incorporate it in the context of particular applications; however, it shall be noted that it is not intended to limit the scope of the present invention. Various modifications, as well as a variety of uses in different applications will be readily apparent to those skilled in the art, and the general principles defined herein may be applied to a wide range of embodiments, and any equivalent modification or variation according to the spirit of the present invention is to be also included within the scope of the present invention. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. § 112, Paragraph 6. In particular, the use of "step of" or "act of" in the claims herein is not intended to invoke the provisions of 35 U.S.C. § 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Generally made of highly water-repellant thermoset elastomer material, such as silicone rubber, thermoplastic elastomers, or other similar soft, flexible plastic materials, the pouring spout guard device 8 pictured in FIGS. 1-7 is generally comprised of the following elements: a flexible body containing a central channel 1 for engaging the lip of a vessel containing fluids or liquids, such channel formed between an inner latching portion made up of two or more gripping elements or "teeth" 3 and an unbroken outer latching lip 5; a pouring surface 10 flanked by side edge bumps and resolving in a top pouring lip 4.

The outer corners of the inner latching wall contain side edge bumps that aid in channeling the liquids in the vessel 6 as they are being directed out of the vessel and towards the pouring surface 10.

FIG. 1 is a perspective view taken from above of one embodiment of the present invention shown applied to a coffee mug 6. The pouring spout guard 8 is applied to the coffee mug 6 by aligning the central channel 1 over the lip of the coffee mug 7 and pressing the pouring spout guard 8 down, thereby causing the coffee mug lip 7 to be introduced into the central channel 1. Once the lip of the coffee mug 7 is inserted into and surrounded by the central channel 1, the pouring spout guard 8 is held in place by the central channel 1, which operates as a clamp around the lip of the coffee mug 7. The inner gripping elements 3 and the outer latching element 5 provide increased clamping forces which combine with the clamping force of the channel to form a secure grip on the liquid's vessel, thereby keeping the pouring spout guard 8 firmly in place while in use.

Figure 2:
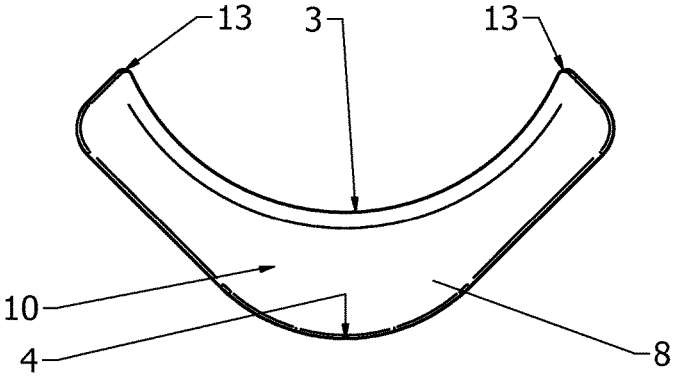
FIG. 2 is a top view of a pouring spout guard in accordance with various embodiments of the present invention.

FIG. 2 is a top view of one embodiment of the pouring spout guard 8 showing the positioning of the side edge bumps 13 that flank the inner wall elements 3 and serve to channel the liquid towards the pouring surface 10 and top pouring lip 4 over which the liquid will be poured.

Figure 3:
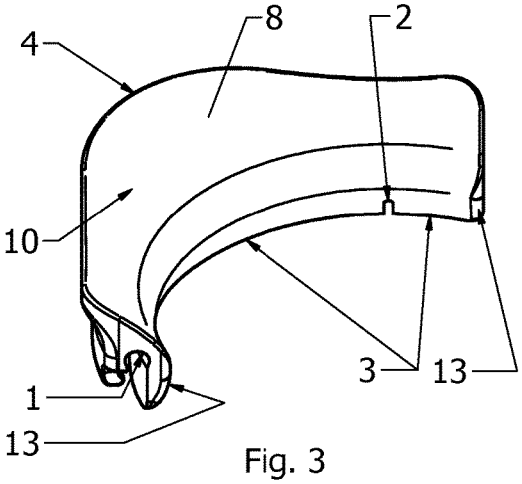
FIG. 3 is a perspective top view of the pouring spout guard of FIG. 2.
Figure 4:
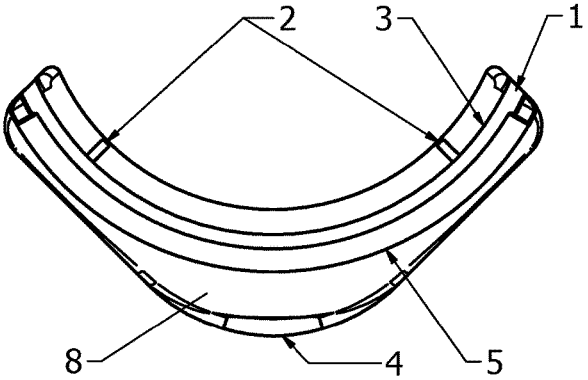
FIG. 4 is a bottom view of the pouring spout guard of FIGS. 2 and 3.

FIG. 3 is a perspective top view of one embodiment of the pouring spout guard 8 showing the inner latching portion of the invention broken into three gripping elements 3 with flexibility grooves 2 situated between each of the gripping elements 3. The flexibility grooves 2 allow the degree of curvature of the pouring spout guard 8 to be expanded or compressed as may be required to fit onto vessels of different sizes. The gripping elements 3 are all of substantially the same length in order to provide a balanced counterforce to that created by the outer latching element 5. Additionally, in the preferred embodiment, the height of the flexibility grooves 2 is limited so as to better prevent liquid from leaking into the space between the inner wall elements 3 and the inner surface of the vessel 6, as when being poured such leaked liquids could enter the central channel 1 and not only jeopardize the clamping force applied to the vessel 6, but also lead to the liquid dripping down onto the exterior of the vessel. In that preferred embodiment, the flexibility grooves 2 will not extend beyond the point on the inner latching portion which is parallel to the bottom of the outer latching element FIG. 4 is a bottom view of one embodiment of the invention showing the placement of the central channel 1, situated between the outer latching element 5 and the inner latching portion's gripping elements 3.

Figure 5:
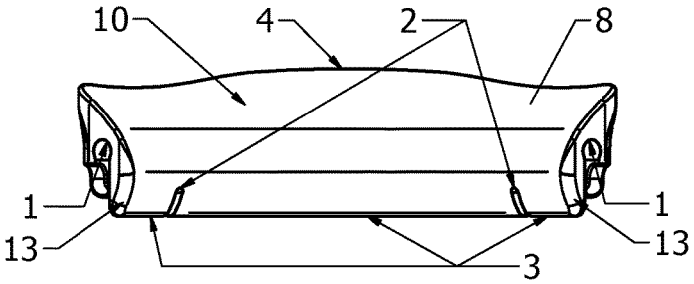
FIG. 5 is a front view of the pouring spout guard of FIGS. 2-4.

FIG. 5 is a front view of one embodiment of the invention showing the inner latching portion broken into three sections, each a gripping element 3, separated by flexibility grooves 2, relative to the central channel 1, the pouring surface 10, pouring lip 4 and side edge bumps 13.

FIG. 6 is a rear view of one embodiment of the invention showing the top pouring lip 4 of the pouring spout guard 8, the positioning of the flexibility grooves 2 separating the inner latching gripping element, as well as showing the relative heights of the outer latching lip 5 in relation to the inner latching gripping elements 3.

FIG. 7 shows a cross-sectional view of one embodiment of the pouring spout guard 8, taken along the line B-B of FIG. 6, showing the positioning of the central channel 1, outer latching lip 5, inner latching portion's gripping elements 3, flexibility grooves 2, side edge bumps 13, pouring surface 10 and top pouring lip 4 relative to one another in this embodiment.

As shown in FIG. 1, the removable pouring spout guard 8 can be affixed to any vessel for holding liquid, such as a coffee mug 6, by sliding the pouring spout guard 8 over the lip of the coffee mug 7. The flexibility of the thermoset elastomer or thermoplastic elastomer material combined with the flexibility grooves 2 between the gripping elements 3 of the inner latching portion allows the degree of curvature of the pouring spout guard 8 to be increased or decreased to match the size of the vessel to which it is applied. The coffee cup lip 7 is inserted between the outer latching lip 5 and inner latching portion's gripping elements 3 and the pouring spout guard 8 is pressed downward until the coffee cup lip 7 rests snugly within the central channel 1. Once properly positioned, the pouring spout guard 8 remains in place due to one or more of the following: the frictional coefficient of the elastomer materials from which the pouring spout guard 8 is produced; a c-clamp grip with a hook design at the bottom formed by use of the central channel 1 element; and the tension between the outer latching lip 5 and gripping elements 3. Once firmly positioned over the coffee cup lip 7, the pouring spout guard 8 can be used to pour liquids out of the coffee mug 6 channeled between the side edge bumps 13 over the pouring surface 10 and past the top pouring lip 4. The curvature of the pouring surface 10 narrows from the innermost edge of the pouring surface 10 to the top pouring lip 4, focusing the flow of liquids into a more narrow stream. The side edge bumps 13 channel and focus the liquid into a narrower stream to flow over the pouring surface 10 and top pouring lip 4, which top pouring lip 4 extends the pouring zone beyond the coffee mug lip 7, and aids in averting spillage or dripping down the side of the coffee mug 6. Additionally, by narrowing the width of the stream of liquid passing over the top pouring lip 4, the user has better control over the pouring of the liquid, and is able to direct the liquid into a container with a narrower opening than the vessel from which it is being poured.

The pouring spout guard 8 can also be used as a drinking aid, providing those persons who might otherwise be prone to spilling, such as children, the elderly or persons suffering from various medical afflictions, including Parkinson's disease, with means to reduce dripping and spillage while consuming liquids. A benefit from channeling the liquid into a narrower stream is that it reduces the amount of control necessary to drink from vessels that are fitted with the pouring spout guard 8.

FIG. 8 is a front view of another contemplated alternative embodiment of the invention showing the inner latching portion of pouring spout guard 11 broken into six gripping elements 3, separated by flexibility grooves 2, relative to the central channel 1, the pouring surface 10, pouring lip 4 and side edge bumps 13.

FIG. 9 is a rear view of the alternative embodiment of the invention pictured in FIG. 8 showing the positioning of the flexibility grooves 2 separating the inner latching gripping element, the relative heights of the outer latching lip 5 in relation to the inner latching gripping elements 3, as well as the textured surface 14 on the interior of the inner gripping elements 3 and top pouring lip 4 of this embodiment of the pouring spout guard 11.

FIG. 10 is a front view of yet another contemplated alternative embodiment of the invention showing the inner latching portion of the pouring spout guard 12 broken into two substantially-equal gripping elements 3, separated by a single flexibility groove 2, relative to the central channel 1, the pouring surface 10, pouring lip 4 and side edge bumps 13.

FIG. 11 is a rear view of the alternative embodiment of the invention pictured in FIG. 10 showing the positioning of the flexibility grooves 2 separating the inner latching gripping element, the relative heights of the outer latching lip 5 in relation to the inner latching gripping elements 3, as well as the textured surface 14 on the interior of the inner gripping elements 3 and top pouring lip 4 of this embodiment of the pouring spout guard 12.

The proposed invention is fully described above mentioned but not limited thereto. It will be apparent to those skilled in the art that various modifications and variations can be made to the present invention without departing from the scope or spirit of the invention. In view of the foregoing, it is intended that the present invention cover modifications and variations of this invention provided they fall within the scope of the invention and its equivalent.

What is claimed is:

1. A flexible pouring spout guard and drinking aid device comprising:

a. a curved gripping structure containing a central channel formed at an intersection and between a curved flexible outer latching wall and a curved flexible inner latching wall where:
   i. the outer wall contains a latching lip element curved inwards towards the inner latching wall;
   ii. the inner wall contains a plurality of grooves dividing the inner latching wall into multiple gripping elements of a substantially same height;
   iii. the central channel having cross-sectional first, second and third widths, with the second width being greater than the first width and the third width being greater than the second width;
   iv. where the first width resides between the latching lip element and the inner latching wall; and
   v. where the plurality of grooves pass through the inner latching wall into portions of the central channel such that the inner latching wall proximate the third width remains free of the plurality of grooves;

b. a pouring lip extending beyond the outer latching wall;

c. a pouring surface positioned above the central channel and extending towards the pouring lip, whereby the flexible pouring spout guard is formed to detachably affix to a segment of a vessel lip of a liquid-containing vessel by positioning the vessel lip within the central channel.

2. The device of claim 1 wherein said flexible inner latching wall contains two grooves, resulting in the inner latching wall being comprised of three gripping elements.

3. The device of claim 1 wherein said flexible inner latching wall contains five grooves, resulting in the inner latching wall being comprised of six gripping elements.

4. The device of claim 1 wherein said flexible inner latching wall contains one groove, dividing the inner latching wall into two gripping elements.

5. The device of claim 1 wherein the flexible pouring spout guard is comprised of a thermoset elastomer material.

6. The device of claim 1 wherein the flexible pouring spout guard is comprised of silicone rubber.

7. The device of claim 1 wherein the flexible pouring spout guard is comprised of thermoplastic elastomer material.

8. The device of claim 1 wherein the flexible pouring spout guard is comprised of thermoplastic polymer material.

9. The device of claim 1 wherein the flexible pouring spout guard is comprised of thermoplastic recycled polymer material.

10. The device of claim 1 wherein the flexible pouring spout guard is comprised of biodegradable material.

11. The device of claim 1, wherein the outer wall terminates laterally in opposing lateral side walls, each lateral side wall rising from the latching lip element to the pouring surface, and wherein each lateral side wall is formed with an indentation proximate the latching lip element.

12. A flexible pouring spout guard and drinking aid device comprising:

a. a curved gripping structure containing a central channel formed at an intersection and between a curved flexible outer latching wall and a curved flexible inner latching wall where:
   i. the outer wall contains a latching lip element curved inwards towards the inner latching wall; and
   ii. the inner wall contains a plurality of grooves dividing the inner latching wall into multiple gripping elements of substantially the same height;
   iii. the central channel having cross-sectional first, second and third widths, with the second width being greater than the first width and the third width being greater than the second width;
   iv. where the first width resides between the latching lip element and the inner latching wall; and
   v. where the plurality of grooves pass through the inner latching wall into portions of the central channel such that the inner latching wall proximate the third width remains free of the plurality of grooves;

b. a pouring lip extending beyond the outer latching wall; and c. a pouring surface positioned above the central channel, the pouring surface having a width, the width starting broadly from inner latching wall and narrowing towards the pouring lip.

13. The device of claim 12, wherein the outer wall terminates laterally in opposing lateral side walls, each lateral side wall rising from the latching lip element to the pouring surface, and wherein each lateral side wall is formed with an indentation proximate the latching lip element.

* * * * *